US011604048B2

(12) United States Patent
Zhang et al.

(10) Patent No.: US 11,604,048 B2
(45) Date of Patent: Mar. 14, 2023

(54) COLLAPSIBLE TARGET STAND

(71) Applicants: Chuanchao Zhang, Walnut, CA (US); Qian Zhang, Walnut, CA (US)

(72) Inventors: Chuanchao Zhang, Walnut, CA (US); Qian Zhang, Walnut, CA (US)

( * ) Notice: Subject to any disclaimer, the term of this patent is extended or adjusted under 35 U.S.C. 154(b) by 129 days.

(21) Appl. No.: 17/242,774

(22) Filed: Apr. 28, 2021

(65) Prior Publication Data

US 2022/0349681 A1 Nov. 3, 2022

(51) Int. Cl.
*F41J 1/10* (2006.01)

(52) U.S. Cl.
CPC ..... *F41J 1/10* (2013.01)

(58) Field of Classification Search
CPC ..... F41J 1/10; E05D 11/1007; A01B 1/022; B26B 1/12; F16M 11/16; F16M 11/28; F16M 11/32–34; F16M 11/38; F16M 11/242–245
USPC ..... 248/158–159, 168–171; 403/81, 83, 403/322.4
See application file for complete search history.

(56) References Cited

U.S. PATENT DOCUMENTS

| | | | | |
|---|---|---|---|---|
| 5,441,267 | A * | 8/1995 | Alder | G09F 17/00 473/173 |
| 5,503,356 | A * | 4/1996 | Shelby | F16M 11/245 40/610 |
| 7,427,069 | B2 * | 9/2008 | Bateman | F41J 1/10 273/406 |
| 9,746,291 | B1 * | 8/2017 | Crawford | F41J 7/04 |
| 9,927,214 | B2 * | 3/2018 | Côté | F41J 5/18 |
| 10,001,350 | B2 * | 6/2018 | Pearcey | F41J 1/10 |
| 10,260,675 | B2 * | 4/2019 | Miller | A47G 33/12 |
| 2009/0256314 | A1 * | 10/2009 | Kobett | F41J 1/10 273/407 |

* cited by examiner

*Primary Examiner* — Laura Davison
(74) *Attorney, Agent, or Firm* — Ying-Ting Chen

(57) ABSTRACT

A collapsible target stand includes a base support assembly having a plurality of legs rotatable between an expanded position wherein the legs are radially arranged and an unexpanded position wherein the legs are disposed adjacent with each other; an upright support frame detachably connected with the base support assembly, the upright support frame including a first support frame connected to a second support frame and a third support frame connected to the second support frame; a locking assembly configured to lock the first support frame in an unfolded position; a target plate being detachable and suspended on the third support frame; wherein the first support frame is rotatable between a folded position wherein the first support frame has one side being coincident with the second support frame and the unfolded position wherein the first support frame is disposed in alignment with the second support frame.

20 Claims, 12 Drawing Sheets

COLLAPSIBLE TARGET STAND

FIELD OF THE DISCLOSURE

The present disclosure relates to a target stand, and more particularly, a collapsible target stand having a base support assembly, an upright support frame, and a target plate, wherein each of the base support assembly, the upright support frame, and the target plate are detachable with each other. Although the present disclosure is suitable for a wide scope of applications, it is particularly suitable for the base support assembly to be expandable and for the upright support frame to be foldable, enable the storage and transportation.

BACKGROUND OF THE DISCLOSURE

Generally, target shooting or shooting competition is a common and popular sport involving shooting at targets generally made of papers having shapes such as a bullseye or game animal or predator thereon. Target shooting can involve shooting at either moving targets or stationary targets. Especially to the stationary targets, the targets are placed at a distance and shot a number of times, and then are moved and replaced with another target. Typically, the targets have to be supported and suspended above the ground, so a conventional target stand has been developed to satisfy as needed.

One non-limiting example of the problems associated with the conventional target stand is that the conventional target stand are not easily transported from place to place and are easily damaged during use and suffer from additional structural shortcoming which necessitate certain new and useful improvement.

To overcome this known problem, a portable target stand has been developed in the market. However, the portable target stand still needs to occupy a larger storage space while the target stand at the storage position. For instance, the support frame is not foldable or even if the support frame has a foldable configuration, it is still lack of mechanism to stably remain the support frame in an upright position.

In another non-limiting example, in order to overcome the impact of the bullets, currently-available portable target stands are designed to be sturdy and steady on the rough, uneven, or sloping ground or snow, and above low bushes or weeds. What is needed is a sturdy, foldable, and portable target stand which can be set up easily and safely without using supplemental tools. The current target stand with sturdy configuration still have to be installed with complicity steps and with supplemental tools in order to position the target thereon.

Considering the somewhat valuable nature of a target stand, the design should be plain and simple, and replacement parts should be easy to find, buy, and install. There may exist a desire to develop a collapsible target stand which is enabled to be set up or collapsed with simple steps.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a collapsible target stand comprises a base support assembly having a plurality of legs rotatable between an expanded position wherein the legs are radially arranged and an unexpanded position wherein the legs are downwardly rotated to be disposed adjacent with each other; an upright support frame detachably connected with the base support assembly, the upright support frame comprising a first support frame having a first top end pivotally connected to a second bottom end of a second support frame and a third support frame pivotally connected to a second top end of the second support frame; a locking assembly configured to lock the first support frame in an unfolded position; a target plate being detachable about and suspended on the third support frame; wherein the first support frame is rotatable between a folded position wherein the first support frame has one side being coincident with the second support frame and the unfolded position wherein the first support frame is unfolded and disposed in alignment with the second support frame.

In another aspect combinable with the general implementation, at least one of the base support assembly further comprises a top plate having an elongated slot where a first bottom end of the first support frame is inserted therethrough.

In another aspect combinable with the general implementation, the first bottom end of the first support frame comprises a broad portion configured to be biased against the top plate and a narrow portion integrally extended from the broad portion to be inserted into the elongated slot.

In another aspect combinable with the general implementation, the locking assembly comprises a receiving slot formed on the second support frame and a U-shaped locking member linked with a lever affixed on the first support frame, wherein the U-shaped locking member is received inside the receiving slot for locking the first support frame in the unfolded position.

In another aspect combinable with the general implementation, the base support assembly further comprises a bottom plate having a plurality of elongated side slots, wherein in the unexpanded position, a part of each of the legs is downwardly rotated and passed through the side slots to be parallelly aligned with each other.

In another aspect combinable with the general implementation, the target stand further comprises a bottom retaining member pivotally connected with the first support frame and the second support frame via two separated pivots, wherein the first top end of the first support frame and the second bottom end of the second support frame are rotatable about the bottom retaining member.

In another aspect combinable with the general implementation, the first support frame comprises a first bottom end opposite of the first top end and detachably connected with the base support assembly, and the second top end of the second support frame is opposite of the second bottom end of the second support frame.

In another aspect combinable with the general implementation, the third support frame comprises a distal end pivotally connected with the second support frame and a proximal end having a protrusion being engaged with a U-shaped mounting member mounted on the target plate.

In another aspect combinable with the general implementation, the base support assembly further comprises a top plate and a bottom plate, wherein an operation cavity is defined between the top plate and the bottom plate with pairs of side plates mounted within the operation cavity.

In another aspect combinable with the general implementation, each pair of the side plates define an operation slot aligned with an elongated side slot formed on the bottom plate, wherein a part of each of the legs is slidable within the operation slot and passed through the elongated side slot.

In another aspect combinable with the general implementation, the lever is downwardly flipped to lock the U-shaped locking member in the receiving slot.

In another aspect combinable with the general implementation, a length of the first support frame is equal to a length of the second support frame.

In another aspect combinable with the general implementation, the top plate consists of an elongated slot.

In another aspect combinable with the general implementation, the locking assembly is arranged on a first right side of the first support frame and a second right side of the second support frame, wherein the first support frame is foldable towards a second left side of the second support frame, wherein the second left side of the second support frame is opposite of the second left side of the second support frame.

In another aspect combinable with the general implementation, the pairs of side plates are vertically arranged and mounted on the top plate and the bottom plate.

In another aspect combinable with the general implementation, the target stand further comprises a pair of bottom retaining members pivotally connected with the first support frame and the second support frame via two separated pivots, wherein a first top end of the first support frame and the second bottom end of the second support frame are rotatable within a bottom retaining slot defining between the pair of the bottom retaining members.

In another aspect combinable with the general implementation, the target plate further comprises a pair of mounting members defining a mounting slot where a proximal end of the third support frame is rotatable and arranged therein.

In another aspect combinable with the general implementation, the pair of the mounting members comprises a U-shaped mounting member having an elongated opening to slidably engage with a protrusion mounted on the third support frame.

In another aspect combinable with the general implementation, in the unfolded position, the first support frame is disposed with respect to the second support frame to form a straight angle.

In another aspect combinable with the general implementation, the third support frame comprises a proximal end having a width greater than a width of a distal end of the third support frame, wherein the proximal end is opposite of the distal end.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Figure 1A:
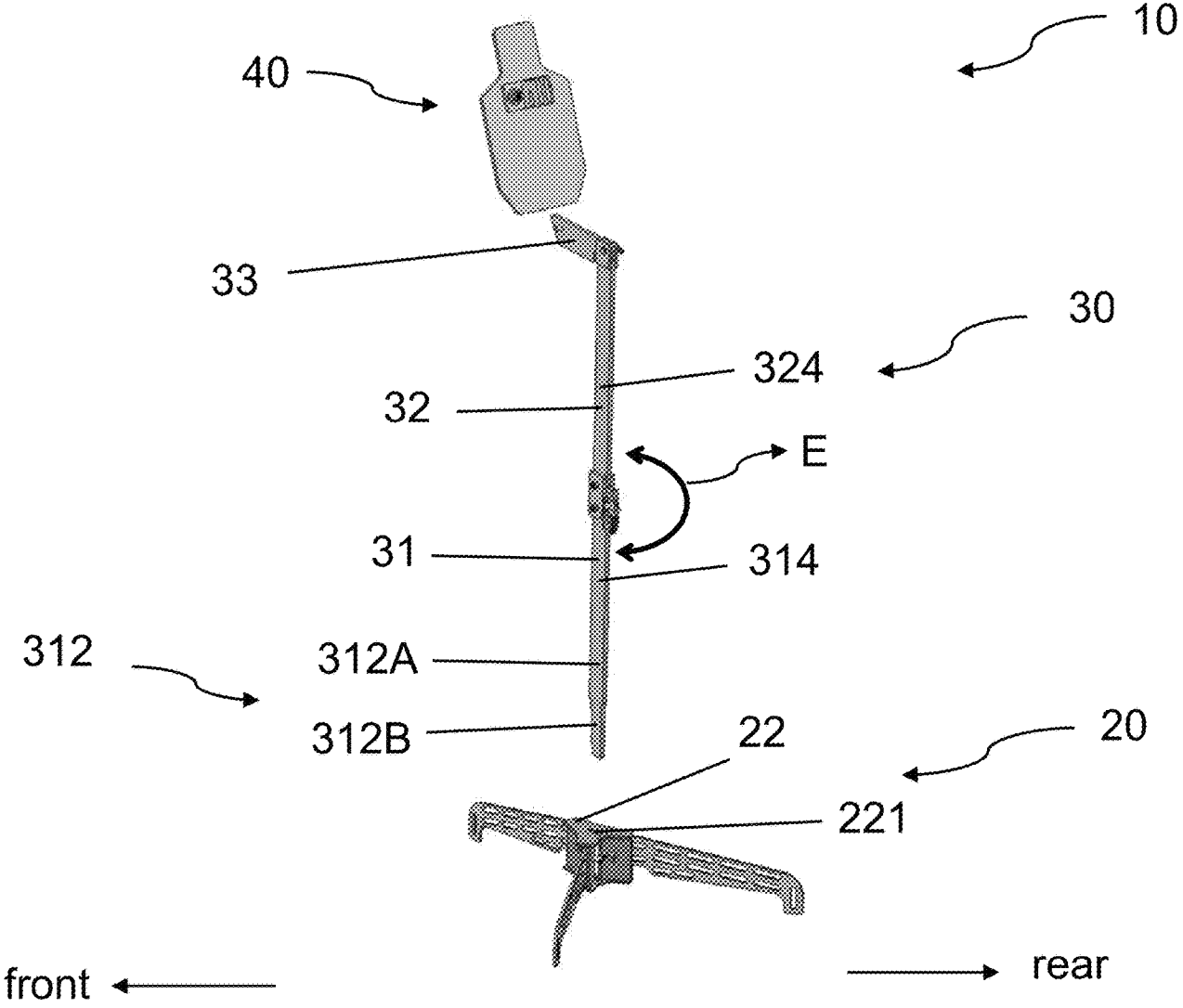
FIG. 1A is an exploded view of a collapsible target stand according to an embodiment.
Figure 1B:
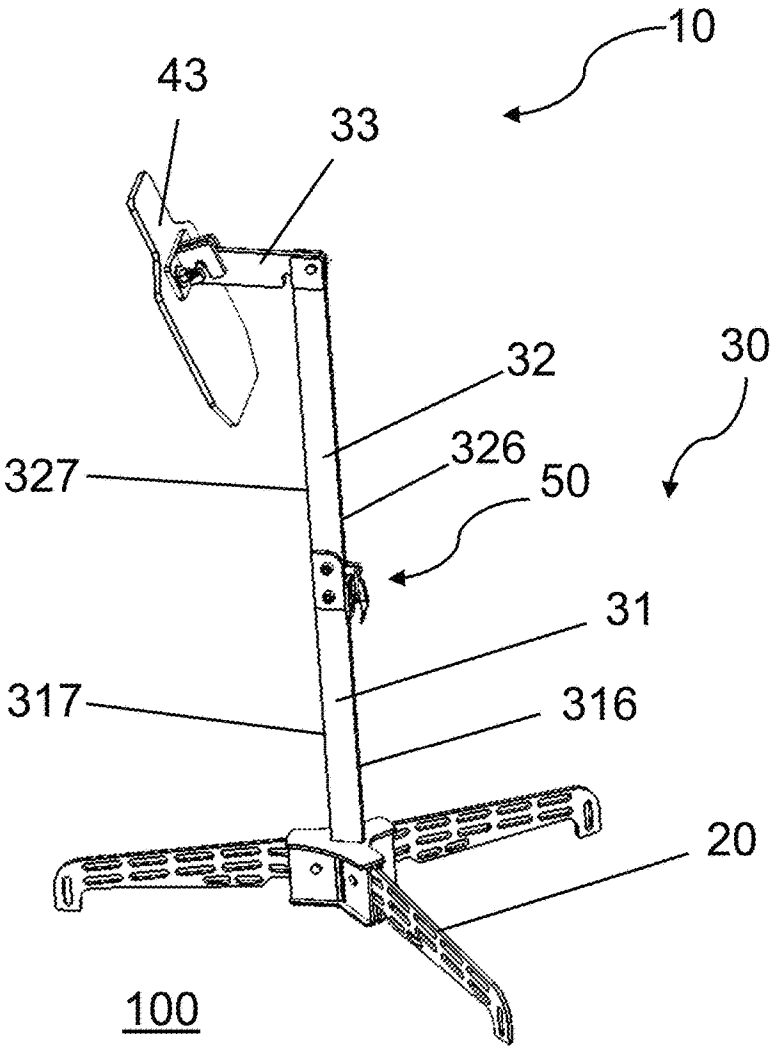
FIG. 1B is a perspective view of the collapsible target stand according to an embodiment.

FIGS. 1A-1B generally depicts views of a collapsible target stand 10 of an embodiment according to an embodiment.

Referring to FIG. 1A, the collapsible target stand 10 comprises a base support assembly 20 detachably connected to an upright support frame 30, and a target plate 40 being detachable and suspended on the upright support frame 30, wherein the upright support frame 30 comprises a first support frame 31 having a first top end pivotally connected to one end (e.g., a second bottom end) of a second support frame 32 and a third support frame 33 pivotally connected to an opposite end (e.g., a second top end) of the second support frame 32. In an embodiment, the first support frame 31 further comprises a first bottom end 312 detachably connected with the base support assembly 20, wherein the first bottom end 312 of the first support frame 31 comprises a broad portion 312A and a narrow portion 312B integrally extended from the broad portion 312A.

In an embodiment, the first support frame 31 comprises a first front side 314 and a first rear side opposite of the first front side 314, wherein a thickness of the first support frame 31 is defined between the first front side 314 and a first rear side. Here, the second support frame 32 comprises a second front side 324 and a second rear side 325 (as shown in FIG. 3C) opposite of the second front side 324 wherein a thickness of the second support frame 32 is defined between the second front side 324 and the second rear side 325.

Referring to FIG. 1B, the target stand 10 further comprises a locking assembly 50 arranged on a first top end of the first support frame 31 and a second bottom end of the second support frame 32, wherein the locking assembly 50 is configured to lock the first support frame 31 and the second support frame 32 in positions.

In an embodiment, the first support frame 31 comprises a first left side 317 and a first right side 316 opposite of the first left side 317, wherein a width of the first support frame 31, including the broad portion 321A and the narrow portion 321B formed on the first bottom end 312 of the first support frame 31, as shown the detail of FIG. 1A, may be defined between a first right side 316 and a first left side 317.

In another embodiment, the second support frame 32 comprises a second left side 327 and a second right side 326 opposite of a second left side 327 of the second support frame 32. Here, a width of the second support frame 32 may be defined between the second right side 326 and the second left side 327.

Figure 2A:
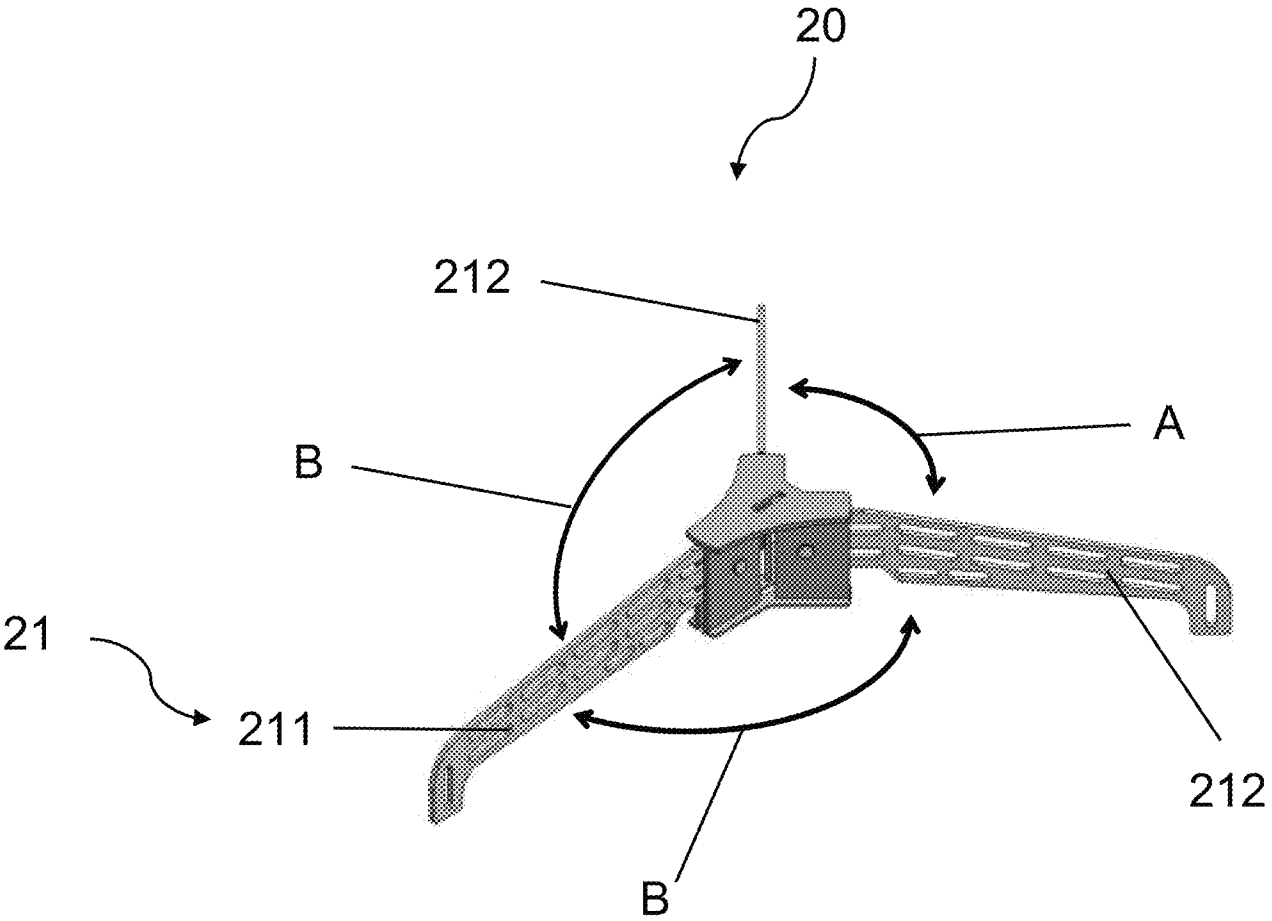
FIG. 2A is a perspective view of a base support assembly according to an embodiment, showing the base support assembly being in an expanded position.
Figure 2C:
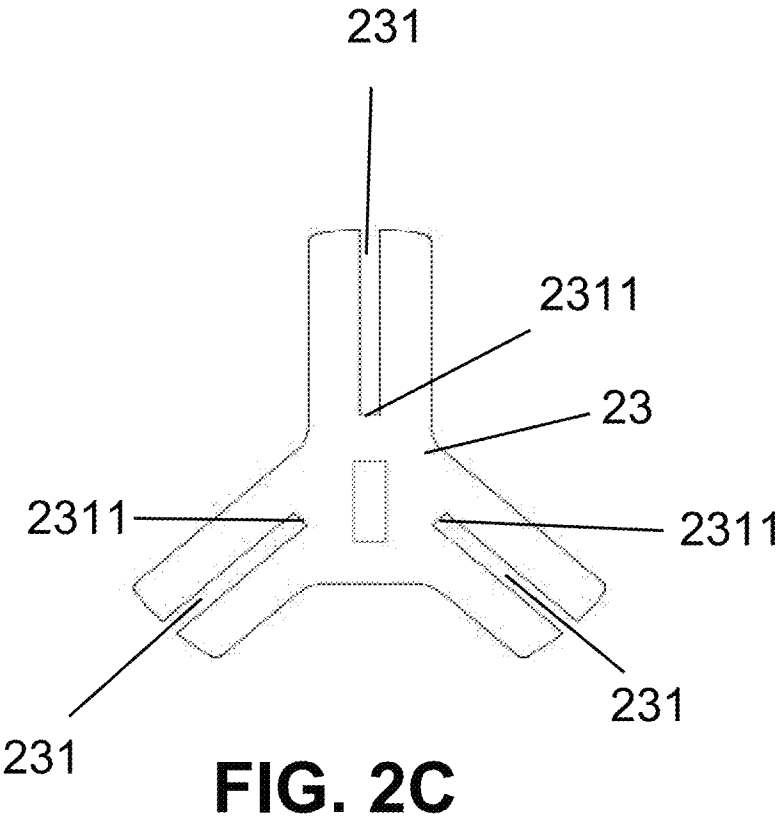
FIG. 2C is a top view of a top plate of a base support assembly according to an embodiment.
Figure 2B:
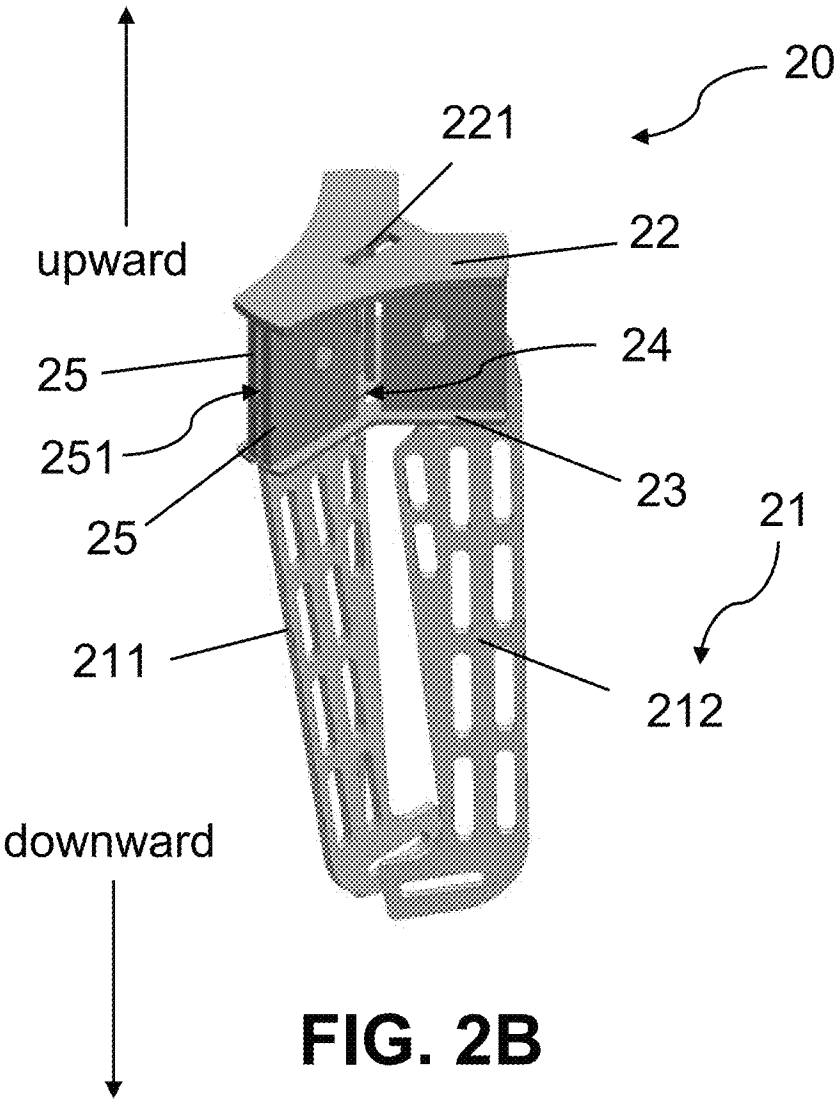
FIG. 2B is a perspective view of a base support assembly according to an embodiment, showing the base support assembly being in an unexpanded position.

FIG. 2A-2C generally depicts sectional views of the base support assembly according to an embodiment.

Referring to FIG. 2A, the base support assembly 20 comprises a plurality of legs 21 rotatable between an expanded position and unexpanded position, wherein in the expanded position, the legs 21 may be radially arranged in a/an predetermined distance and angle. The legs 21 comprises a front leg 211 and a pair of rear legs 212, wherein the pair of rear legs 212 may be symmetrically arranged about the front leg 211. In an embodiment, in the expanded position, each one of the rear legs 212 may be formed as an angle "A" of about 90 degrees with respect to the other one of the pair of the rear legs 212, wherein the front leg 211 may be formed an angle "B" of about 120 degrees with respect to the rear legs 212.

Referring to FIGS. 2B to 2C, in an embodiment, the base support assembly 20 further comprises a top plate 22 having an elongated slot 221 and a bottom plate 23 having a plurality of elongated side slots 231, wherein a part of each of the legs 21 may be downwardly rotated and passed through the side slots 231 to be parallelly aligned with each other.

In an embodiment, the base support assembly 20 further comprises an operation cavity 24 defined between the top plate 22 and the bottom plate 23 and pairs of side plates 25 mounted within the operation cavity 24, wherein each of the pairs of side plates 25 may be vertically arranged and directly mounted on the top plate 22 and the bottom plate 23. Here, each pair of the side plates 25 define an operation slot 251 which may be aligned with the elongated side slot 231 formed on the bottom plate 23. During a rotation of the legs 21, each one of a part of the legs 21 (e.g., only partial leg) may be slidable and rotatable within the operation slot 251 and be passed through the elongated side slot 231 for parallelly aligning with each other.

In another embodiment, the narrow portion 312B of the first bottom end 312 of the first support frame 31 may be inserted into the elongated slot 221 of the top plate 22 to support the upright support frame 30 on the base support assembly 20, wherein the broad portion 312A of the first support frame 31 may be biased against the top plate 22 so as to lock the first bottom end 312 of the first support frame 31 on the base support assembly 20, as shown with the details of FIGS. 1A-1B. In other words, the broad portion 312A may have a width greater than a width of the narrow portion 312B, wherein the width of the narrow portion 312B is smaller than a length of the elongated slot 221, wherein the width of the broad portion 312A is greater than the length of the elongated slot 221. The narrow portion 312B may have the width smaller than the length of the elongated slot 221 in order to facilitate inserting the narrow portion into the elongated slot 221.

In an embodiment, the elongated slot 221 may be formed at a center of the top plate 22 to enhance the upright support frame 30 being stably support on a ground surface 100 (as shown the details of FIG. 1B).

Referring to FIG. 2B, in the unexpanded position, the legs 21 may be downwardly rotated at a predetermined angle to be disposed adjacent with each other, wherein the predetermined angle may be about 90 degrees. In an embodiment, the legs 21 may be parallel alignment with each other to form the unexpanded position.

It is noted that the top plate 22 of the base support assembly 20 consists of the elongated slot 221. For example, during the rotation of the legs 21, the legs 21 may be biased against the top plate 22 to prohibit the legs being upwardly rotated, as shown further detail in FIG. 2A. The legs 21 only could be downwardly rotated 90 degrees, and one side of each of the legs 21 may be biased against an inner slot edge 2311 of each of the elongated side slots 231 to perform the unexpanded position.

In an embodiment, each of the legs 21 may be pivotably connected with one pair of the side plates 25 at a pivot, wherein each of the pivots formed by one of the legs 21 and the pair of the side plates 25 is at the same level of another one of the pivots.

FIGS. 3A-3D depict views of the collapsible target stand 10 according to an embodiment.

Figure 3B:
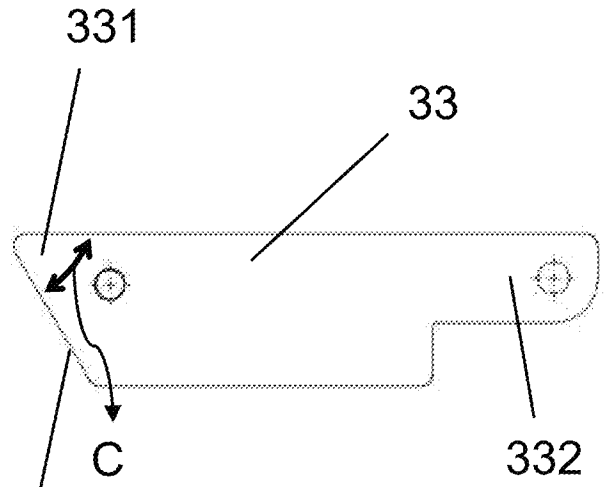
FIG. 3B is a side view of a third support frame according to an embodiment.
Figure 3A:
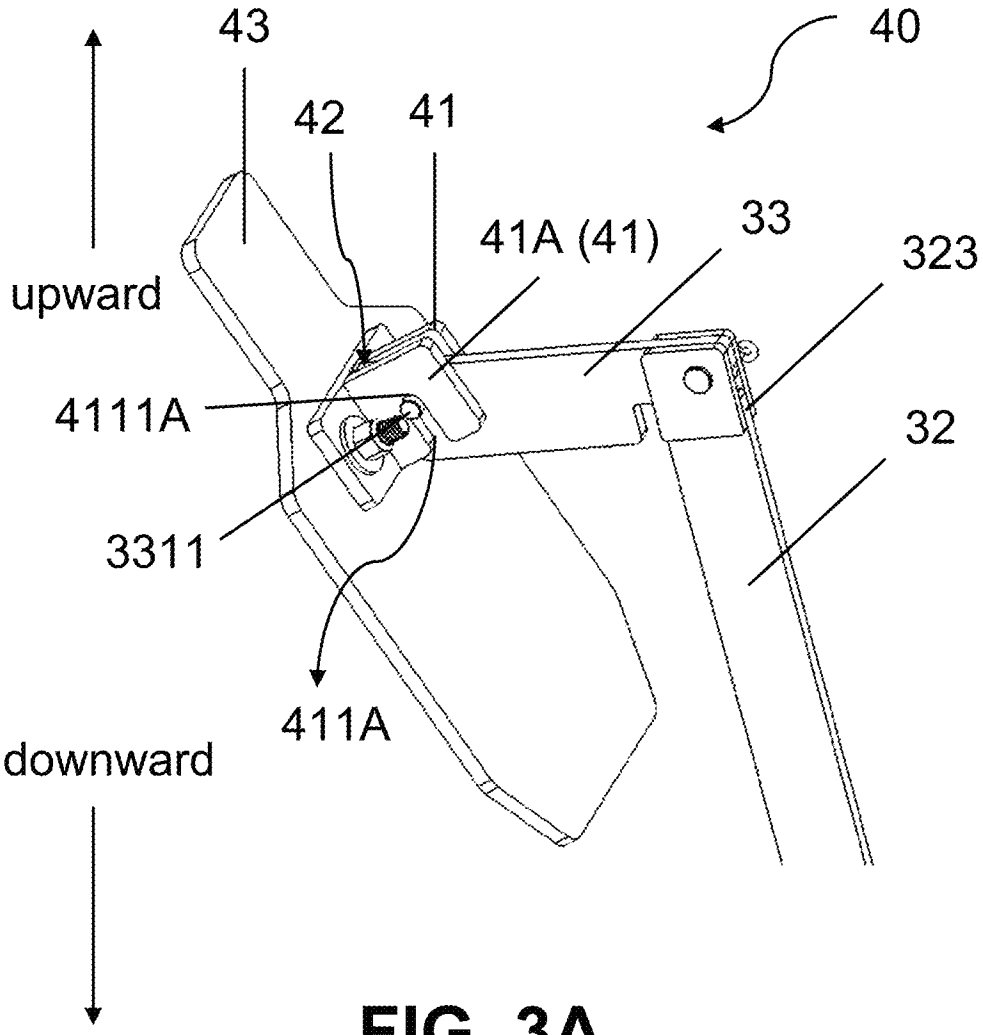
FIG. 3A is a perspective view of an upright support frame according to an embodiment, showing a target plate being suspended on the upright support frame.
Figure 3C:
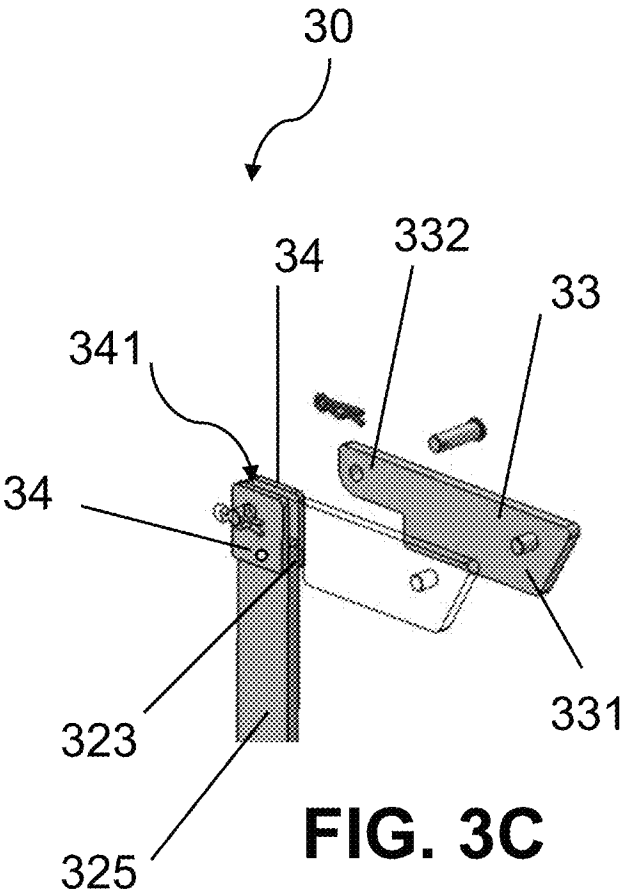
FIG. 3C is a perspective view of the third support frame according to an embodiment, showing the third support frame being pivotally mounted on a second support frame.

Referring to FIGS. 3A-3C, the target plate 40 further comprises a pair of mounting members 41 defining a mounting slot 42 therebetween, wherein the pair of the mounting members 41 comprises a U-shaped mounting member 41A having an elongated opening 411A configurated to be slidably engaged with a protrusion 3311 mounted on the third support frame 33. In an embodiment, the third support frame 33 comprises a proximal end 331 having a thickness greater than a thickness of a distal end 332 of the third support frame 33, wherein the proximal end 331 is opposite of the distal end 332. The protrusion 3311 may be mounted on the proximal end 331 of the third support frame 33 and the distal end 332 of the third support frame 33 may be pivotally connected with the second top end 323 of the second support frame 32.

In an embodiment, the proximal end 331 of the third support frame 33 may be slidable within the mounting slot 42, wherein the protrusion 3311 of the proximal end 331 may be slid into the elongated opening 411A and be biased against an inner opening edge 4111A of the elongated opening 411A. It is noted that, for example, when the target plate 40 is suspended or hanged on the third support frame 33, the protrusion 3311 of the third support frame 33 may be biased against the inner opening edge 4111A of the elongated opening 411A by a gravity of the target plate 40; therefore, the target plate 40 may be locked on the third support frame 33.

Figure 3D:
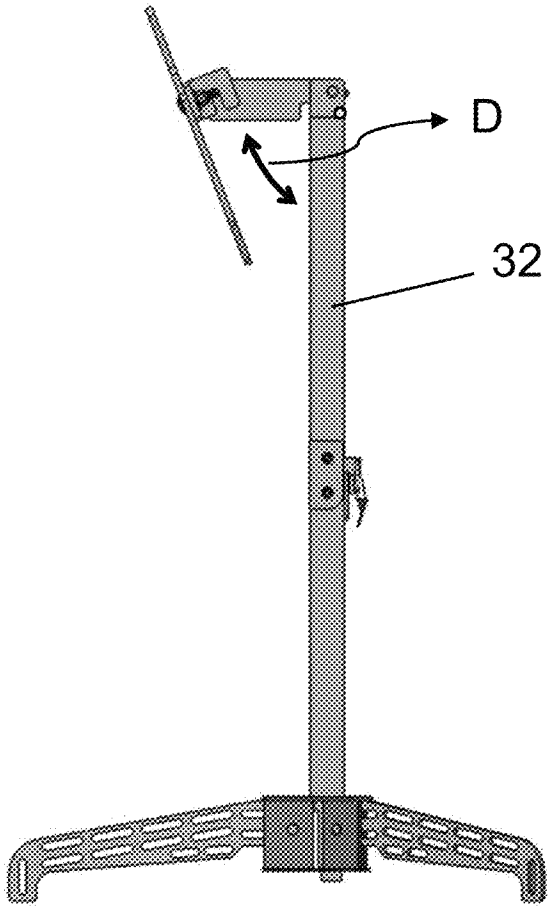
FIG. 3D is a side view of the collapsible target stand according to an embodiment.

In another embodiment, referring to FIGS. 3A-3B and 3D, the elongated opening 411A may be parallel alignment with a target board 43, wherein an opening end of the elongated opening 411A may be faced downwardly. Here, the proximal end 331 of the third support frame 33 may be formed as an angle "C" about 45 degrees and may comprise an angled edge 3312. For example, when target plate 40 is suspended and supported on the third support frame 33, the angled edge 3312 of the proximal end 331 of the third support frame 33 may be biased against the target board 43, and in this way, the target board 43 may be suspended or hanged on the third support frame 33 to form an angle "D" about 45 degrees with respect to the target board 43.

In still another embodiment, referring to FIGS. 3A-3C, the upright support frame 30 further comprises at least one top retaining member 34 where the distal end 332 of the third support frame 33 and the second top end 323 of the second support frame 32 may be pivotally arranged on the top retaining member 34. Here, the top retaining members 34 may be formed in pair and define a top retaining slot 341 formed between the pair of the top retaining members 34, wherein the distal end 332 of the third support frame 33 and the second top end 323 of the second support frame 31 may be rotatable operated within the top retaining slot 341. It is noted that the top retaining member 34 may be configured to enhance the stability of the a connection between the third support frame 33 and the second support frame 32, so as to prevent the third support frame 33 being ripped off or bumped off the second support frame 32.

In still another embodiment, the third support frame 33 may be rotatably operated with the top retaining members 34 and within the top retaining slot 341, wherein the pair of the top retaining members 34 may be affixed on the second top end 323 of the second support frame 32.

Referring to FIG. 3C, the second top end 323 of the second support frame 32 and the distal end 332 of the third support frame 33 may be pivotally connected with the top retaining members 34 via two separated pivots. Therefore, the second support frame 32 may be rotated with respect to the top retaining member 34 without rotating the third support frame 33. In other words, the third support frame 33 may be rotated with respect to the top retaining members 34 without rotating the second support frame 32. The flexibility of the third support frame 33 and the second support frame 21 may be enhanced by the above descriptions.

Figure 4:
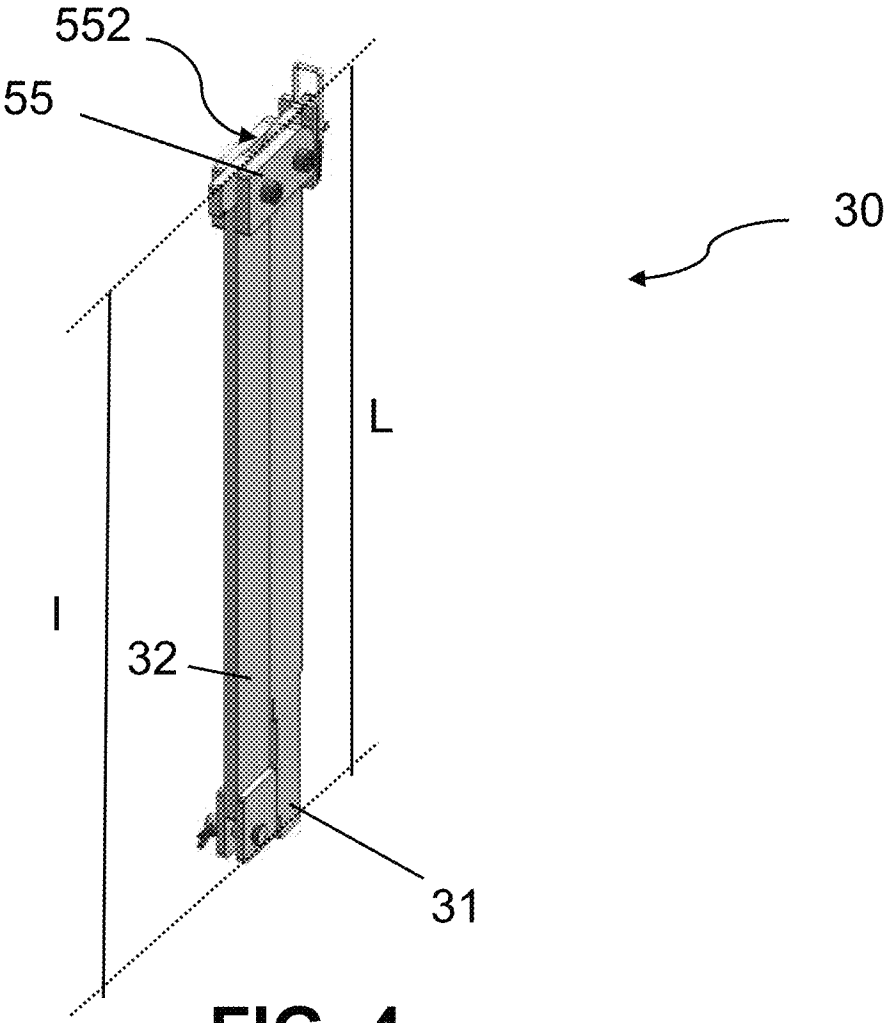
FIG. 4 is a perspective view of the collapsible target stand according to an embodiment, showing a first support frame being disposed at a folded position.

FIG. 4 depicts a perspective view of the upright support frame 30 according to an embodiment.

Referring to FIG. 4, the first support frame 31 may be rotated between a folded position and unfolded position, wherein in the folded position, the first support frame 31 may be folded to have one side (e.g., the first left side 317) being coincident with the second left side 327 of the second support frame 32 (as shown detail of FIG. 1B). In an embodiment, the first support frame 31 may be folded towards the second left side 327 of the second support frame 32 in order to perform the folded position.

In an embodiment, in the unfolded position, as shown details of FIG. 1A, the first support frame 31 is unfolded and disposed in alignment with the second support frame 32 to from a straight angle "E".

In another embodiment, as shown in FIG. 4, a length "L" of the first support frame 31 may be equal to a length "1" of the second support frame 32.

In another embodiment, in order to support the target board 43 being in uses and suspended on the third support frame 33, the base support assembly 20 must be at the expanded position and the first support frame 31 must be at the unfolded position, as shown in FIG. 1B, wherein the base support assembly 20 may be utilized to support the upright support frame 30 on the ground surface 100, and the upright support frame 30 may be utilized to support the target board 43 being hanging above the ground surface 100.

In still another embodiment, in the folded position, continuing to FIG. 4, the first support frame 31 may be overlapped with the second support frame 32 to form a flat surface, wherein the thickness of the first support frame 31 may be equal to the thickness of the second support frame 32.

Figure 5A:
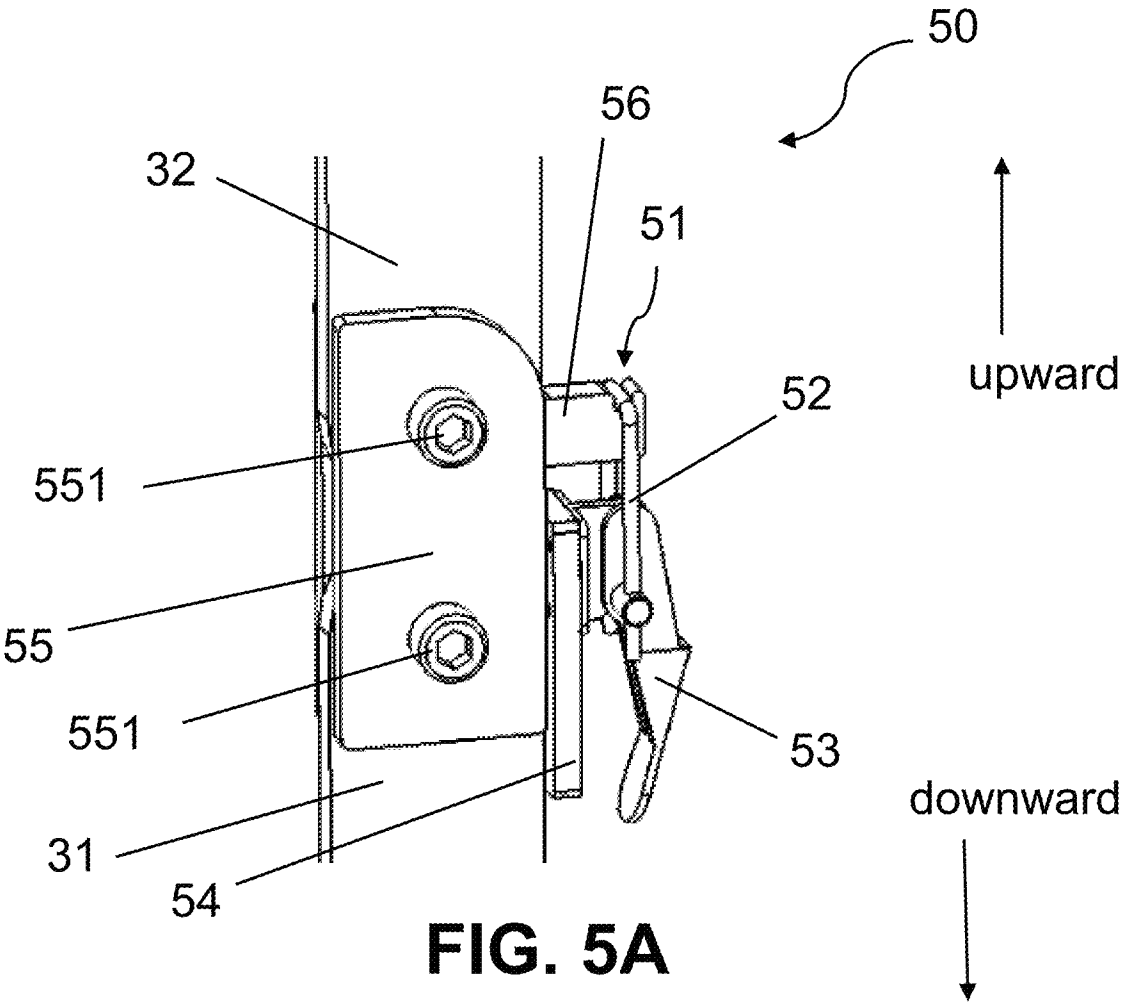
FIG. 5A is a perspective view of a locking assembly according to an embodiment.
Figure 5B:
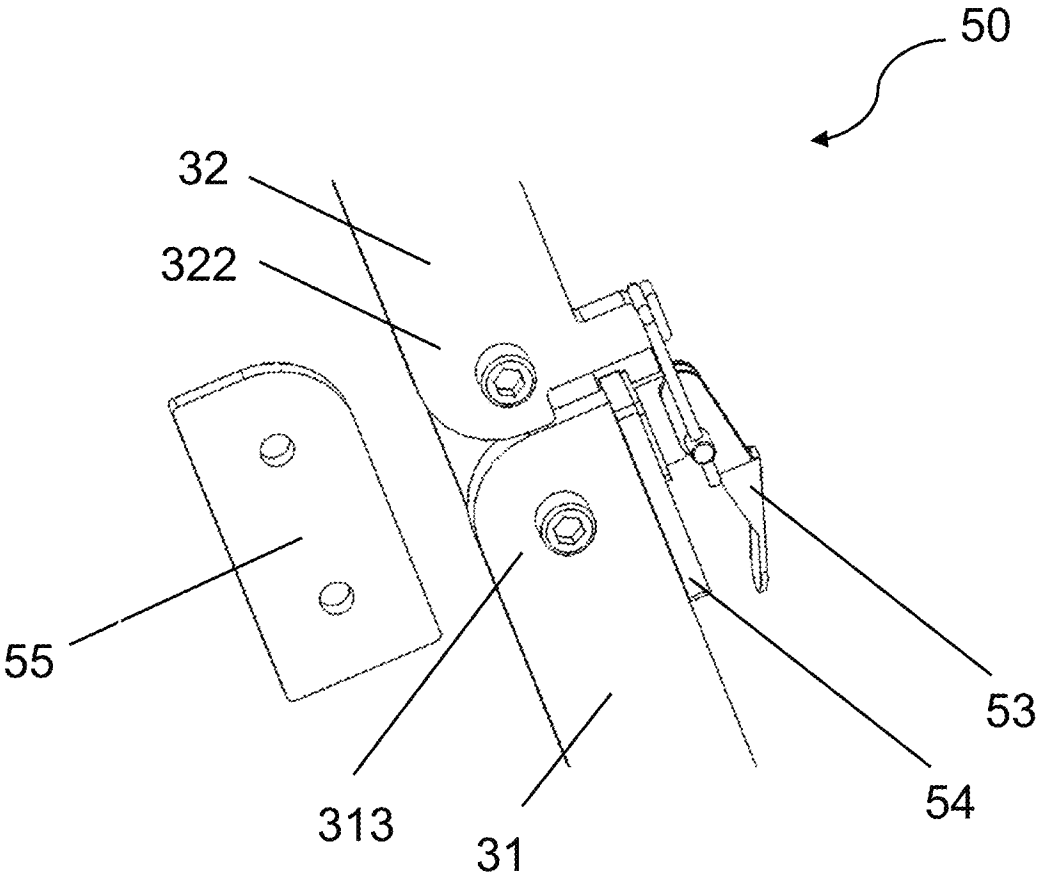
FIG. 5B is a perspective view of the locking assembly according to an embodiment.

FIGS. 5A-5B depict sectional views of the locking assembly according to an embodiment.

Referring to FIG. 5A, the locking assembly 50 comprises a receiving slot 51 formed on the second support frame 32 and a U-shaped locking member 52 linked with a lever 53 affixed on the first support frame 31, wherein in order to lock the first support frame 31 with the second support frame 32 to from the straight angle, the U-shaped locking member 52 may be received inside the receiving slot 51 for locking the first support frame 31 in the unfolded position, as shown details of FIG. 1B. In other words, in the folded position, the U-shaped locking member 51 may be released from the receiving slot 51 and may not be received inside the receiving slot 51, as shown details of FIG. 4.

In an embodiment, referring to FIG. 5B, the locking assembly 50 further comprises a base member 54 mounted on the first top end 313 of the first support frame 31 and the lever 53 may be mounted the base member 54. Here, the base member 54 may be utilized to support the lever 53 connected with the first support frame 31.

Referring to FIGS. 5A to 5B, the locking assembly 50 further comprises a bottom retaining member 55 pivotally connected with the first top end 313 of the first support frame 31 and the second bottom end 322 of the second support frame 32, wherein the first top end 313 of the first support frame 31 and the second bottom end 322 of the second support frame 32 may be rotatable about the bottom retaining member 55.

In an embodiment, the bottom retaining member 55 may be pivotally connected with the first support frame 31 and the second support frame 32 via two separated pivots 551. Here, the bottom retaining member 55 may be formed in pair, and the pair of bottom retaining members 55 may be pivotally connected with the first support frame 31 and the second support frame 32 via two separated pivots 551, wherein the first top end 313 of the first support frame 31 and the second bottom end 322 of the second support frame 32 may be rotatable between the pair of the bottom retaining members 55.

In another embodiment, in the folded position, the bottom retaining members 55 may be vertically arranged with respect to the first support frame 31 and the second support frame 32, as shown in FIG. 4. The bottom retaining members 55 may be configured to enhance a stability of a connection between the first support frame 31 and the second support frame 32.

Continuing to FIGS. 5A to 5B, the lever 53 of the lock assembly 50 may be downwardly flipped and moved away the receiving slot 51, wherein the U-shaped locking member 52 linked with the lever 53 may be simultaneously moved to and locked within the receiving slot 51. Here, the receiving slot 51 may be formed on a locking flange 56 outwardly and integrally extended from the second support frame 32. For example, while the U-shaped locking member 52 is received in the receiving slot 51 and is pulled to move towards the downward direction, the U-shaped locking member 52 may be securely locked within the receiving slot 51, and simultaneously, the first support frame 31 may be locked in the unfolded position with respect to the second support frame 32.

In an embodiment, the lever 53 of the lock assembly 50 may be upwardly flipped and moved towards the receiving slot 51, wherein the U-shaped locking member 52 linked with the lever 53 may be moved away and released from the receiving slot 51. In this way, the first support frame 31 may be folded to be coincident with the second support frame 32 in order to perform the folded position.

According to all of the embodiments described above, referring to further details of FIG. 4, the lock assembly 50 may be arranged outside the bottom retaining members 55, wherein the lock assembly 55 further comprises a bottom retaining slot 552 defined between the pair of the bottom retaining members 55. Here, the lock assembly 50, including the locking flange 56 having the receiving slot 51, the U-shaped locking member 52, and the base member 54, may be disposed outside the bottom retaining members 55, as shown in FIG. 5A.

Figure 6A:
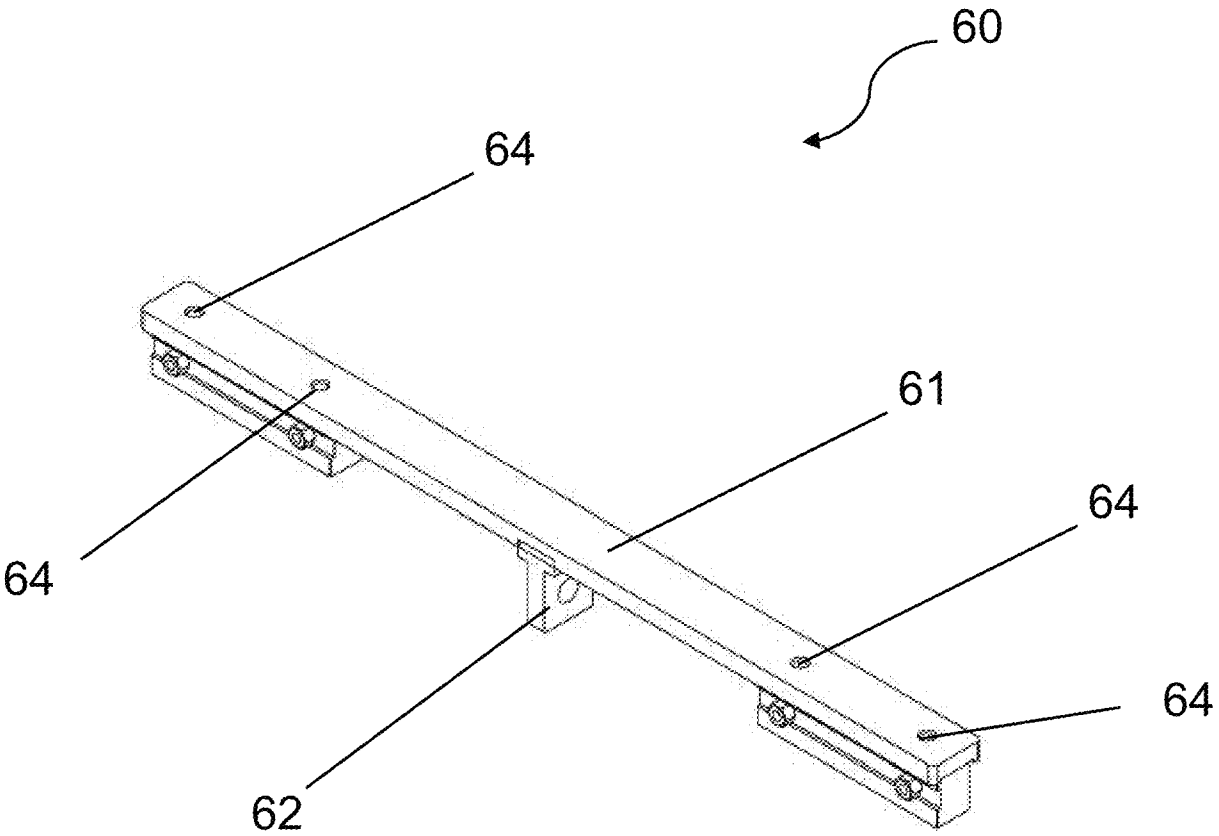
FIG. 6A is a perspective view of a frame adaptor according to an embodiment.
Figure 6B:
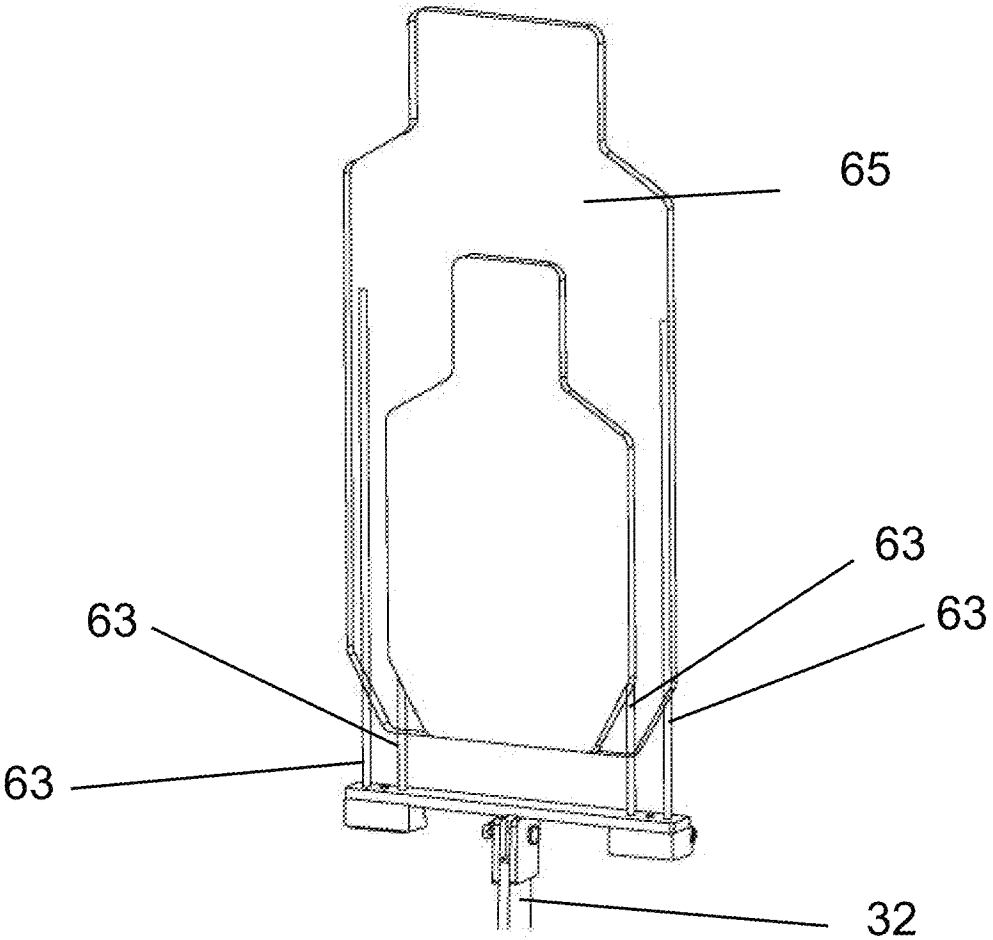
FIG. 6B is a perspective of the frame adaptor having a paper target board supported thereon according to an embodiment.
Figure 7:
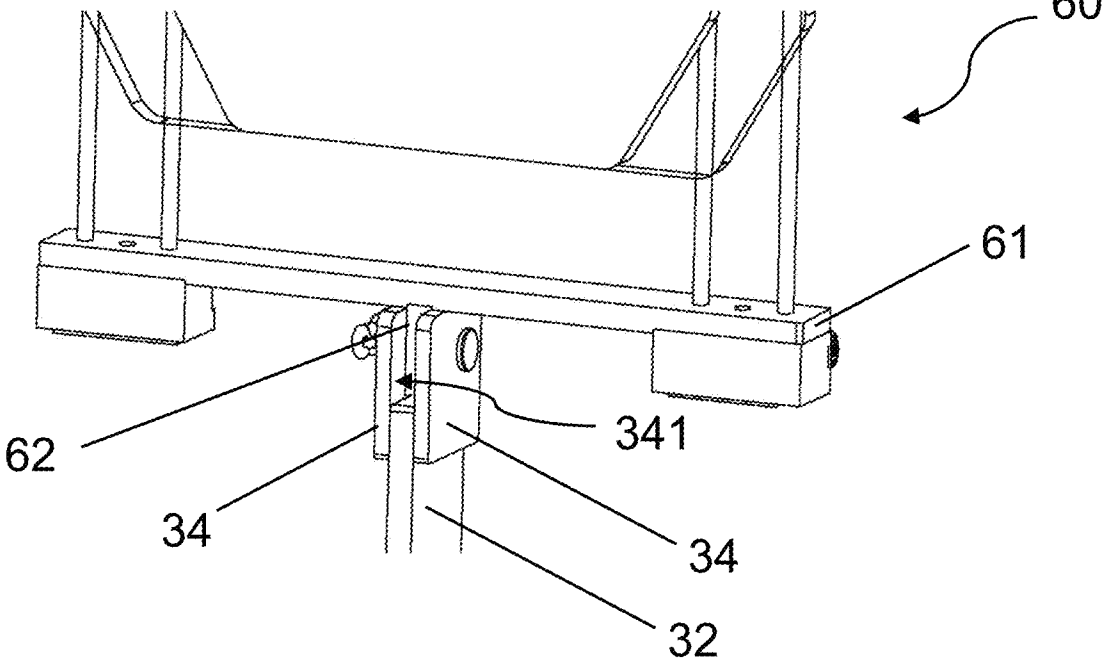
FIG. 7 is a perspective view of the frame adaptor according to an embodiment, showing a locking connector being mounted on the second support frame.

FIGS. 6A-6B and 7 generally depicts perspective views of a frame adaptor for the collapsible target stand according to an embodiment.

Referring to FIGS. 6A-6B and 7, the target stand further comprises the frame adapter 60 to be selectively and detachably mounted on top retaining member 34.

In an embodiment, the frame adaptor 60 comprises an elongated supporting arm 61, a locking connector 62 mounted on a bottom side of the supporting arm 61, and at least one supporting rod 63 detachably coupled on a top side of the supporting arm 61, wherein the bottom side of the supporting arm 61 is opposite of the top side of the supporting arm 61, and the top side of the supporting arm 61 comprises a plurality of locking holes 64 configured to engage with the supporting rods 63 for supporting the supporting rods 63 being vertically arranged with respect to the supporting arm 61. In an embodiment, each of the supporting rods 63 may be parallel alignment with another one of the supporting rods 63.

In an embodiment, the frame adaptor 60 further comprises a paper target board 65 supported on the plurality of the supporting rods 61. For example, the paper target board 65 may be supported on the frame adapter 60 for shooting purposes.

As shown in FIG. 3C, the third support frame 33 may be detached from the top retaining members 34 and released from the second top end 323 of the second support frame 32. In an embodiment, for example, the locking connector 62 of the frame adaptor 60 may be inserted into the top retaining slot 341 formed between the pair of the top retaining members 34 and may be locked with the top retaining members 34 via an adapter pivot, as shown in FIG. 7. Here, the top retaining members 34 may be affixed on the second top end 323 of the second support frame 32, and the second top end 323 of the second support frame 32 may be sandwiched between the pair of the top retaining members 34. It is noted that the third support frame 33 may be selectively and rotatably attached on the pair of the top retaining members 34 affixed with the second top end 323 of the second support frame 32 and the target board 43 may be suspended thereon. Selectively, while the third support frame 33 may be detached from the second support frame 32, the locking connector 62 of frame adaptor 60 may be inserted into the top retaining slot 341 and affixed on the top retaining members 34 in order to install on the second support frame 32 and support the paper target board 65 above the ground surface 100.

According to all of the embodiments described above, the target board 43 may be a metal target board, and the paper target board 65 may be a paper cardboard.

According to all of the embodiments describes above, the contemplated collapsible target stand 10, including the base support assembly 20, the upright support frame 30, and the target plate 40, can be made of suitable bulletproof materials to have abrasion resistant and withstand repeated shots, such materials include AR500 steel and all reasonable combinations thereof.

It should be understood that the above-described material is exemplary and any other material can be adopted in various embodiments of this disclosure.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of a collapsible target stand have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A collapsible target stand, comprising:

a base support assembly having a plurality of legs rotatable between an expanded position wherein the legs are radially arranged and an unexpanded position wherein the legs are downwardly rotated to be disposed adjacent with each other;

an upright support frame detachably connected with the base support assembly, the upright support frame comprising a first support frame pivotally connected to one end of a second support frame and a third support frame pivotally and detachably connectable to an opposite end of the second support frame;

a locking assembly configured to lock the first support frame in an unfolded position;

a target plate being detachably suspended on the third support frame; wherein the first support frame is rotatable between a folded position wherein the first support frame has one side being coincident with the second support frame and the unfolded position wherein the first support frame is unfolded and disposed in alignment with the second support frame.

2. The target stand of claim 1, wherein the base support assembly further comprises a top plate having an elongated slot where a first bottom end of the first support frame is inserted therethrough.

3. The target stand of claim 2, wherein in the unfolded position, the first bottom end of the first support frame comprises a broad portion configured to be biased against the top plate and a narrow portion integrally extended from the broad portion to be inserted into the elongated slot.

4. The target stand of claim 1, wherein the locking assembly comprises a receiving slot formed on the second support frame and a U-shaped locking member linked with a lever affixed on the first support frame, wherein the U-shaped locking member is received inside the receiving slot for locking the first support frame in the unfolded position.

5. The target stand of claim 4, wherein the lever is downwardly flipped and moved away from the receiving slot to guide the U-shaped locking member to be locked in the receiving slot.

6. The target stand of claim 1, wherein the base support assembly further comprises a bottom plate having a plurality of elongated side slots, wherein in the unexpanded position, a part of each of the legs is downwardly rotated and passed through the side slots, wherein each of the legs being parallelly aligned with each other.

7. The target stand of claim 1, wherein the first support frame comprises a first bottom end opposite of a first top end and detachably connected with the base support assembly, wherein the first top end is pivotally connected to the second support frame.

8. The target stand of claim 1, wherein the third support frame comprises a distal end pivotally connected with the second support frame and a proximal end having a protrusion engaging with a U-shaped mounting member mounted on the target plate.

9. The target stand of claim 1, wherein the base support assembly further comprises a top plate and a bottom plate having elongated side slots, wherein an operation cavity is defined between the top plate and the bottom plate with pairs of side plates mounted within the operation cavity.

10. The target stand of claim 9, wherein each pair of the side plates define an operation slot aligned with an elongated side slot formed on the bottom plate, wherein a part of each of the legs is slidable within the operation slot and passed through the elongated side slots in the unexpanded position.

11. The target stand of claim 9, wherein the top plate comprises an elongated slot.

12. The target stand of claim 9, wherein the pairs of side plates are vertically arranged and mounted directly on the top plate and the bottom plate.

13. The target stand of claim 1, wherein the locking assembly is arranged on a first right side of the first support frame and a second right side of the second support frame, wherein the first support frame is foldable towards a second left side of the second support frame, wherein the second left side of the second support frame is opposite of the second right side of the second support frame.

14. The target stand of claim 1, wherein the locking assembly further comprises a pair of bottom retaining members pivotally connected with the first support frame and the second support frame via two separated pivots, wherein a first top end of the first support frame and the one end of the second support frame are rotatable within a bottom retaining slot defined between the pair of the bottom retaining members.

15. The target stand of claim 1, wherein the target plate further comprises a pair of mounting members defining a mounting slot therebetween where a proximal end of the third support frame is rotatable and arranged therein.

16. The target stand of claim 15, wherein each mounting member of the pair of the mounting members is a U-shaped mounting member having an elongated opening to slidably engage with a protrusion mounted on the third support frame.

17. The target stand of claim 1, wherein in the unfolded position, the first support frame is disposed with respect to the second support frame to form a straight angle.

18. The target stand of claim 1, further comprising a frame adaptor detachably connectable to the opposite end of the second support frame, wherein the frame adaptor comprises an elongated supporting arm and a locking connector mounted on the supporting arm.

19. The target stand of claim 18, wherein the upright support frame further comprises a pair of top retaining members defining a top retaining slot formed between the pair of the top retaining members, wherein the second support frame is affixed within the top retaining slot.

20. The target stand of claim 19, wherein the locking connector is fastened on the pair of the top retaining members and within the top retaining slot when the third support frame is detached from the second support frame.

* * * * *